United States Patent [19]

Bittner

[11] 3,939,957

[45] Feb. 24, 1976

[54] CARRIAGE OPERATED RIBBON DRIVE AND REVERSE MECHANISM

[75] Inventor: John R. Bittner, Waynesboro, Va.

[73] Assignee: General Electric Company, Waynesboro, Va.

[22] Filed: Dec. 11, 1973

[21] Appl. No.: 423,734

[52] U.S. Cl. ..... 197/151; 197/165

[51] Int. Cl.[2] ..... B41J 33/14

[58] Field of Search ..... 197/151, 153 R, 160, 161, 197/162, 163, 164, 165, 175

[56] References Cited

UNITED STATES PATENTS

| | | | |
|---|---|---|---|
| 747,917 | 12/1903 | Hillard | 197/151 |
| 825,457 | 7/1906 | Halle | 197/153 R |
| 826,481 | 7/1906 | Donning | 197/151 |
| 959,833 | 5/1910 | Alexander | 197/162 |
| 1,140,273 | 5/1915 | McLaughlin | 197/153 R |
| 1,902,007 | 3/1933 | Wood | 197/175 X |
| 2,105,279 | 1/1938 | Weber | 197/153 R |
| 2,724,332 | 11/1955 | Schlessiger et al. | 101/336 |
| 2,811,235 | 10/1957 | Geissler | 197/151 X |
| 3,207,284 | 9/1965 | Pateman et al. | 197/151 |
| 3,354,822 | 11/1967 | Dollot | 197/160 X |
| 3,401,783 | 9/1968 | Norwood et al. | 197/151 |
| 3,726,381 | 4/1973 | Murphy | 197/151 X |

*Primary Examiner*—Ernest T. Wright, Jr.
*Attorney, Agent, or Firm*—Michael Masnik

[57] ABSTRACT

A printer arrangement of the type which prints data serially along a line on a record medium by relative impact of type characters and record medium through a ribbon. Printing is a mixture of stop and go printing, essentially a character at a time, and continuous printing of a plurality of characters. Driving power for the ribbon is derived from carriage movement on which the print head is mounted through controllable clutch and toggle switch action. The toggle switch action reverses ribbon drive direction in response to a depletion of ribbon signal.

3 Claims, 8 Drawing Figures

CARRIAGE OPERATED RIBBON DRIVE AND REVERSE MECHANISM

INTRODUCTION

This invention relates to printers of the type having an inked ribbon that is reversibly traversed under tension across a printing area and more particularly to new and improved non-jamming, reversible, tensioning ribbon spool drive mechanisms for use therewith.

High speed printers of the type that are employed as remote terminal printers for computer readout and the like generally utilize electromechanically actuated ribbon driving and reversing mechanisms. The nature of the high speed printer due to its high speed of operation precludes incremental movement of the ribbon in the manner employed in conventional typewriters whereby ribbon indexing is accomplished as a by-product of type bar motion through mechanical association. Hence the drive mechanisms for the ribbon spools on which the printing ribbon is paid out and taken up must tension the ribbon, be located for ready replaceability by the operator, be automatically reversing and must be independently driven at a low speed. Reliability and operation further requires that the reversing and tensioning spool drive mechanism be essentially jam-proof to avoid or minimize mechanical breakdown. Problems increase when the printer is designed to print characters serially on a stop and go basis, one at a time, or to print characters serially in a continuous fashion across a line of type. Efforts at achieving or overcoming these problems heretofore have resulted either in excessively complicated structures or structures which tended to malfunction because of environmental and operational factors such as dust, ink, ribbon material, etc.

It is therefore an object of the present invention to provide a new and improved ribbon tensioning and reversing spool drive mechanism.

Another object of the invention is to provide an improved arrangement for detecting a low ribbon condition for reversing direction of ribbon drive.

Another object of this invention is to provide a ribbon drive and reverse function over a wide range of changes in printing rates.

Another object of this invention is to provide an improved arrangement for operating a ribbon drive and reversing mechanism from the linear movement of a carriage which supports both the ribbon drive and reversing mechanism as well as the printing head.

A further object of this invention is to provide an improved ribbon drive and reverse mechanism wherein ribbon drive is suspended during carriage return or whenever printing is suspended as for example during the execution of nonprinting control commands.

A still further object of this invention is to provide a ribbon drive mechanism for moving an inked ribbon in a stop and go and/or continuous movement motion.

In accordance with one aspect of the invention, there is provided a reversible spool drive mechanism for moving a ribbon at desired speeds in either direction between a pair of ribbon spools. Said spool drive mechanism comprises a drive housing coupled to each spool which also serves to retain the ribbon itself. A driving shaft is provided for each spool with an associated toothed cone clutch mechanism which selectively causes the driving shaft to communicate driving power to the associated spool drive housing for driving the ribbon spool. Drive power is achieved as follows. Each drive mechanism is mounted on the carriage for movement with the carriage along a line of print. A respective toothed pulley is coupled to each of the spool driving shafts and adapted to mate with a linearly extended spool drive belt mounted to be stationary with respect to carriage movement. Means are provided for engaging the teeth of both pulleys with the teeth of the stationary spool drive belt in a manner to drive both driving shafts simultaneously. In order to cause the spools to operate alternately to take up or pay out ribbon, a toggle mechanism is provided for causing one of the spool clutch mechanisms to engage and the other to disengage in response to a minimum ribbon balance left on the one spool. Ribbon tension is controlled by an adjustable drag brake on the spool housing. All this results in an improved arrangement. While the specification concludes with claims particularly pointing out and distinctly claiming the subject matter which is regarded as the invention, an illustration of several particular embodiments can be seen by referring to the specification in connection with the accompanying drawing wherein:

The present invention is particularly suited for filling the ribbon advance and low ribbon detections and switching requirements in a high speed printer wherein the carriage carrying the print head for causing serial printing along a line operates on a stop and go basis a character at a time or can print characters continuously along a line.

DESCRIPTION OF TYPICAL EMBODIMENTS

Figure 1:
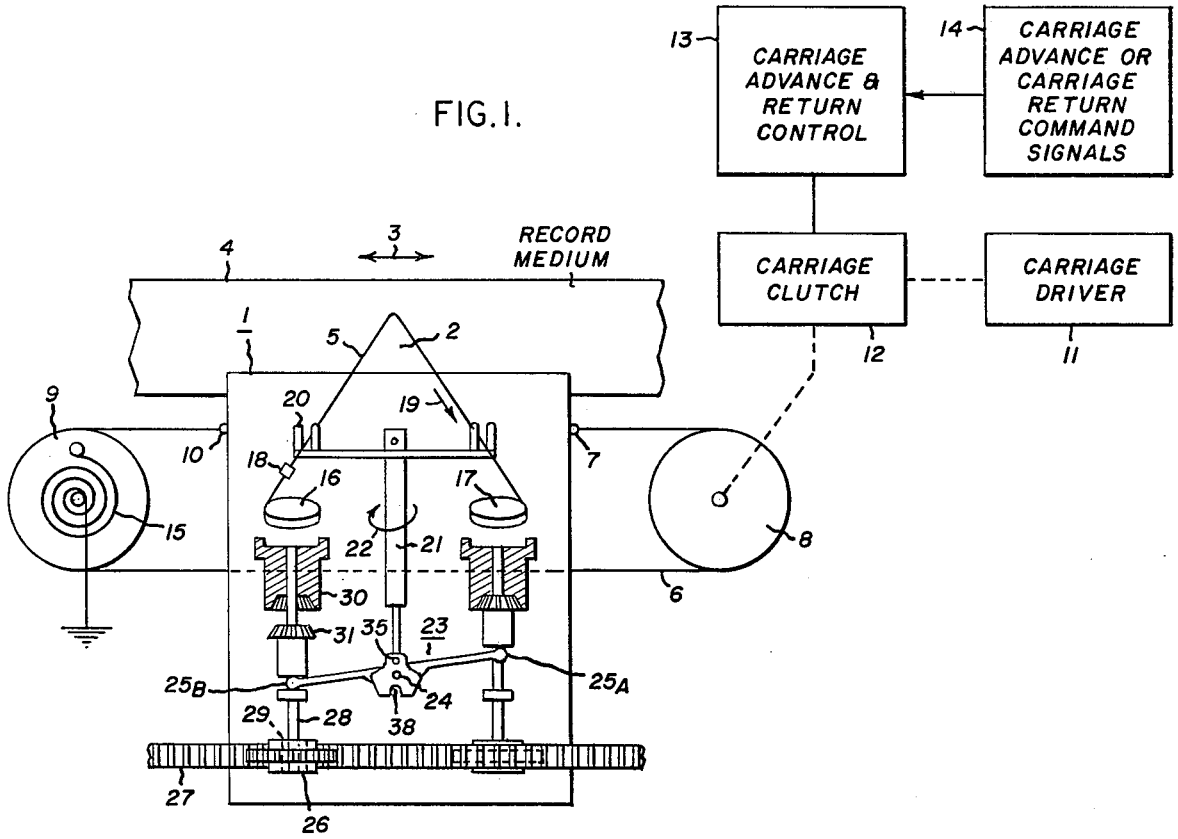
FIG. 1 illustrates in part schematic, part block diagram form a generalized description of a printer arrangement embodying the present invention.

Referring to FIG. 1 there is shown in generalized form a printer arrangement comprising a carriage 1 which supports a print head 2. Movement of carriage 1 causes the print head 2 to traverse a line of movement along the direction of the arrows 3 across a record medium 4. The print head 2 may comprise any one of several types of print heads which under the influence of character print signals causes character forming elements to impact through a ribbon 5 to cause a graphic impression of the character to be formed on the record medium 4, such as paper. In a particular embodiment print head 2 comprises a series of 7 vertical needles or styli which under the control of character forming input signals causes a five by seven dot matrix pattern of the character to be formed on the record medium 4. Movement of the carriage 1 and hence the print head 2 is controlled by a driving medium 6 connected at one end to the carriage 1 at point 7 and wrapped around the driving pulley 8 with the other end wrapped around the return pulley 9 before being connected at point 10 to the carriage 1. Pulley 8 responds to a driving force delivered by carriage driver 11 through a carriage clutch mechanism 12 to cause the carriage 1 to be moved in the carriage advance direction, that is to the right to cause printing to take place from left to right on the record medium 4. Carriage movement may be incremental, that is stop and go, or continuous under the control of the carriage advance and carriage return controller 13. Controller 13 responds to carriage advance or carriage return command signals available from a source 14 to cause the clutch 12 to apply or remove driving power from driver 11 to the pulley 8 and hence the medium 6 and carriage 1. Upon receipt of a carriage return signal from source 14, controller 13 removes the driving power from clutch 12 and hence the pulley 8 enabling the return pulley 9 to swiftly return the carriage 1 to its line originate position under the influence of carriage return spring 15. Spring 15 may be a torsion spring which stores up energy during the carriage advance motion and releases the energy during the carriage return motion.

Figure 3:
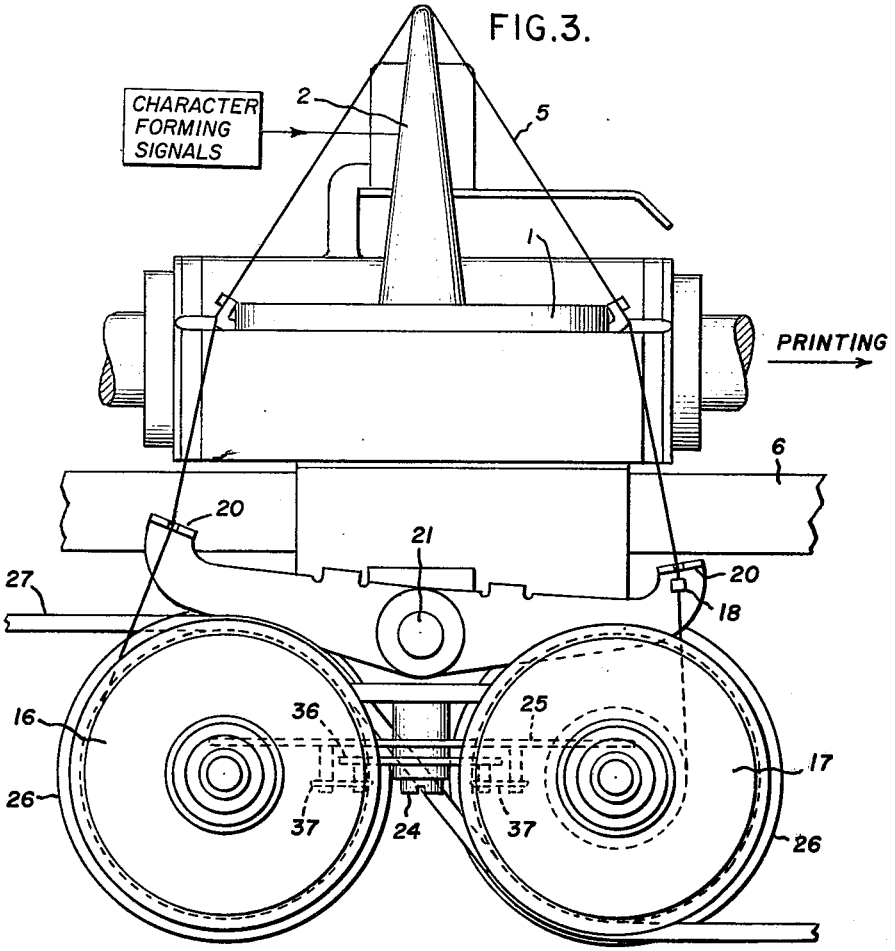
FIGS. 3 and 4 illustrate details of the ribbon reverse mechanism.

During motion of the carriage 1 under intermittent or continuous operation it is desirable to advance the ribbon 5 in order to provide a continuously fresh source of ink surface to enable legible printing to occur. Referring to FIG. 3, ribbon 5 is available from a pair of ribbon spools 16 and 17 on which the ribbon 5 is wound. Near the point at which the ribbon 5 attaches to each of the spools 16, 17 there is provided a ribbon eyelet 18 or other similar snagging device to signal that the end of the ribbon 5 is being approached. During operation one of the ribbon spools 16, 17 operates as a drive spool and the other one as an idler or payout spool. For purposes of discussion and for the particular position shown, spool 17 is the drive spool and spool 16 is the idler spool. The ribbon 5 moves in the direction of arrow 19 under the application of a driving force applied to the spool 17. The manner in which spool 17 functions in the idler or drive mode will be shortly described in connection with the operation of the left hand spool 16. As the end of the ribbon 5 is sensed by eyelet 18 engaging the shift fork 20, a force is applied which causes toggle shaft 21 to rotate in the direction of arrow 22. Rotation of shaft 21 causes the toggle mechanism 23 to rotate about shaft 24 causing right toggle plate end 25A to be driven downward and left toggle plate end 25B to be driven upward. The details of the toggle and the toggling action will become apparent from a further description in connection with FIGS. 5A and 5B. For the present it is sufficient that we note that the end of ribbon signal is translated into a toggling action which can be used to effect ribbon reverse.

In the arrangement of FIG. 1 power for driving the ribbon spools 16, 17 is obtained by way of the relative motion of a movable pulley 26 carried on the carriage 1 and associated with spool 16 and a fixed belt 27 which is stationary with respect to carriage motion. The reversible spool drive mechanism is mounted on the carriage for movement therewith. For details of such mounting reference can be made to FIGS. 2 and 4. As the carriage 1 is moved in the direction of carriage advance, input shaft drive pulley 26, coupled by a one-way clutch 29 (shown in FIG. 2) to the remainder of the spool drive mechanism, is caused to rotate clockwise with respect to stationary belt 27 due to engagement of teeth on pulley 26 and corresponding teeth on belt 27. Input drive shaft 28 is engaged to the drive pulley 26 through a one-way clutch mechanism 29. The clutch mechanism 29 is so biased that it causes intimate coupling between the drive shaft 28 and drive pulley 26 during the carriage advance movement but results in decoupling of these two during the carriage return movement. This prevents any ribbon motion during the carriage return mode. Drive shaft 28 is coupled to the spool housing 30 through a toothed cone clutch 31. Spool 16 is intimately engaged with the housing 30 in any well known manner such as a snap-on drive pin arrangement, etc. In the position shown and before the eyelet 18 signals end of ribbon condition, housing 30 is decoupled from the drive shaft 28 causing the spool 16 to operate in the idler or payout mode. When the eyelet 18 snags the fork 20, toggle mechanism 23 causes the left hand shift toggle plate end 25B to move in the upward direction causing clutch 31 to engage housing 30 thus coupling input drive shaft 28 to housing 30 such that movement of drive pulley 26 now results in spool 16 operating in the drive mode causing the ribbon 5 to reverse direction from that shown at 19 and to be paid out from the spool 17. This payout from spool 17 continues until the eyelet 18 associated with the end of the ribbon 5 attached to spool 17 signals the end of ribbon condition causing the fork 20 associated with ribbon 5 to initiate toggling action by toggle mechanism 23 and repeating the cycle. For purposes of simplicity, details of the driving mechanism associated with spool 17 have been omitted. However, it should be noted that the driving mechanism associated with spool 16 is repeated with respect to spool 17.

Thus it is seen that the arrangement of FIG. 1 operates to provide ribbon drive and ribbon reversing functions over wide ranges of carriage movement and enhance printer operation — from intermittent operation to continuous and only during the carriage advance mode.

Figure 2:
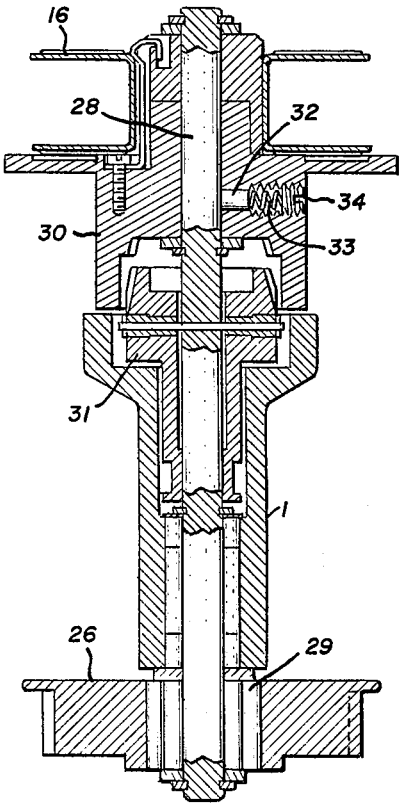
FIG. 2 illustrates the details of the ribbon drive and clutch mechanism of the present invention.
Figure 4:
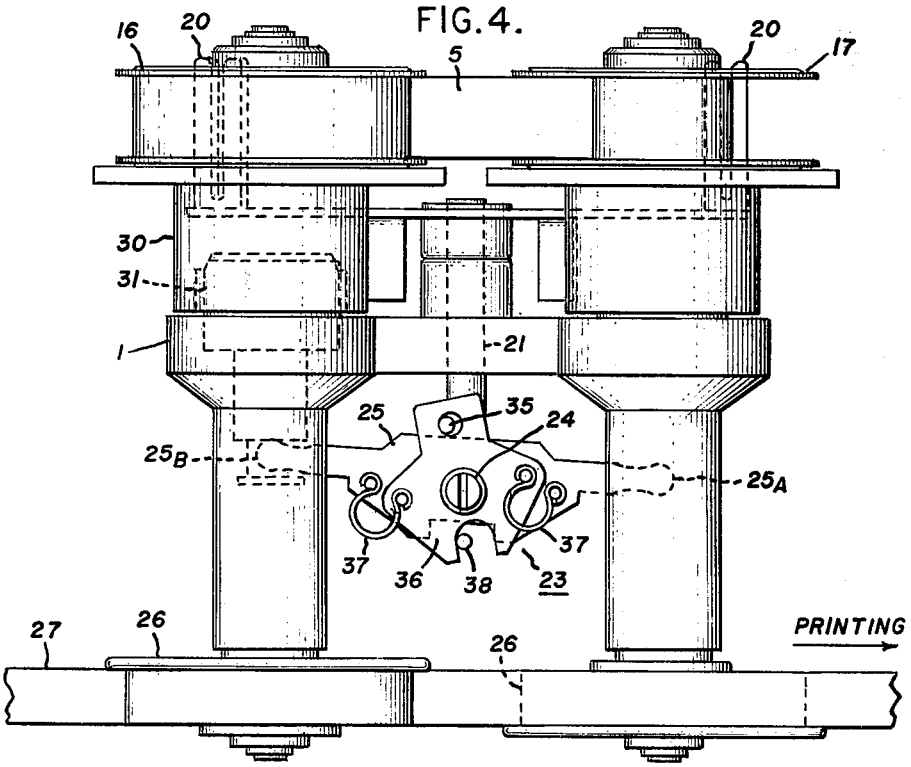

Reference is now made to FIG. 2 of the drawing which illustrates the details of the ribbon drive and clutch mechanism of the present invention. Whenever possible or practical, common reference numerals have been retained in FIG. 2 for those used in FIG. 1. Cross-section view of FIG. 2 illustrates how the spool 16 is attached to the spool drive housing 30 which in turn is driven by the input shaft 28 through the operation of clutch 31. The toggling action is shown in greater detail in subsequent figures. The arrangement of FIG. 2 shows the unitary construction employed and the manner in which all moving parts are protected against environmental pollution or detriments such as dust, paper and ribbon ink particles, etc. This figure illustrates the manner in which the driving teeth of the toothed cone clutch 31 along its upper tapered end mesh with the driven teeth of the spool drive housing 30, along its corresponding tapered end mating with clutch 31 teeth, upon being advanced upwardly in response to the toggle action. Also upon a change in the toggle action in which power is removed from the spool 16 associated with the engaged housing 30, the driving teeth of the clutch 31 are driven out of engagement with the driven teeth of the housing 30. In order to provide a controllable adjustment of the ribbon tension necessary to proper printing operation, a friction brake arrangement is provided comprising a brake shoe 32 which is urged into engagement against the input drive shaft 28 by a bias spring 33 which is adjustably compressable by means of a threaded set screw 34. Thus by adjustment of the set screw 34 in either direction the braking action on the input shaft 28 may be modified. FIG. 4 is a front view of the arrangement showing some details of the toggle mechanism 23. In the position shown the toggle mechanism 23 has operated to cause power to be applied from the drive pulley 26 associated with the left hand spool 16 through the associated cone clutch 31 shown dotted to the drive shaft housing 30. The fork or yoke 20 is shown coupled through its toggle shaft 21 and the shift pin 35 to the shift toggle front plate 36. As previously mentioned when a ribbon spool 16, 17 is depleted, the eyelet 18 on the end of the ribbon 5 engages the yoke 20 because the eyelet 18 cannot fit through the slot and causes the shaft 21 to rotate as the ribbon 5 is fed through. This rotational action causes the shift shaft 21 and shift pin 35 to rotate. The shift pin 35 on the toggle shaft 21 engages the front shift toggle plate 36 and starts that plate 36 rotating. The front and rear shift toggle plates 36, 25 are interconnected by means of over-center springs 37. As the front toggle shift plate 36, through its rotational action, causes an over-center condition of the springs 37 to take place and come to rest against the ground pin 38, the spring force is transferred to the rear toggle plate 25. Ground pin 38 limits the rotational travel of the front toggle shift plate 36. This spring force produces a torque about the pivot pin 24 causing the rear toggle shift plate 25 to rotate. As the rear toggle shift plate 25 rotates, the ends 25A and 25B (since they engaged with the cone clutches 31) move these cone clutches 31 in a vertical direction, that is one side up and the other side down. This engages the clutch 31 on one spool 16, 17 and disengages the clutch 31 of the other spool 16, 17. The ribbon spool 16, 17 that was previously depleted and unwinding will now become the driver and vice versa with regards to the other ribbon spool 16, 17. As soon as this happens the eyelet 18 will start returning to the spool hub. Each ribbon spool 16, 17 has the mechanism and capabilities associated with it as described above.

Figure 5A:
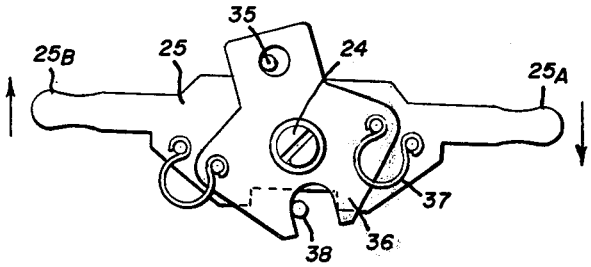
FIGS. 5A and 5B illustrate the functioning of the ribbon reverse toggle mechanism.
Figure 5B:
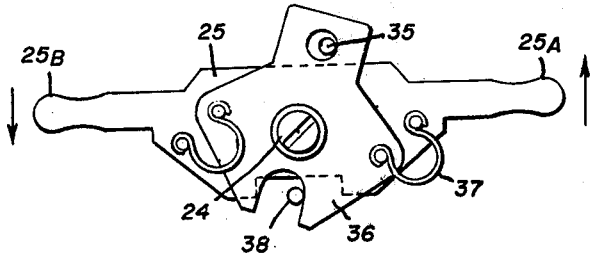

FIGS. 5A and 5B show toggle plates 25 and 36 and over-center springs 37 in both wind and unwind conditions for both ribbon spools 16, 17. In FIG. 5A, end 25B causes ribbon winding by spool 16 and in FIG. 5B, end 25A causes winding by spool 17.

Figure 6:
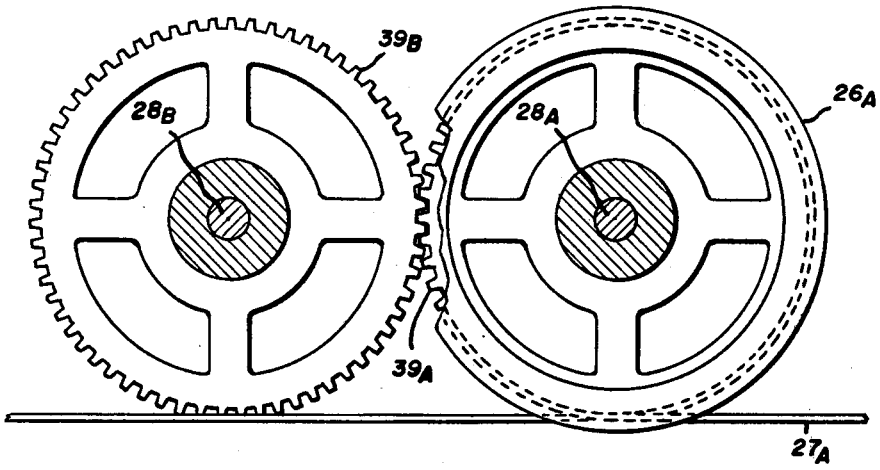
FIGS. 6 and 7 illustrate further mechanisms to provide power take-off from carriage motion relative to a stationary drive belt.
Figure 7:
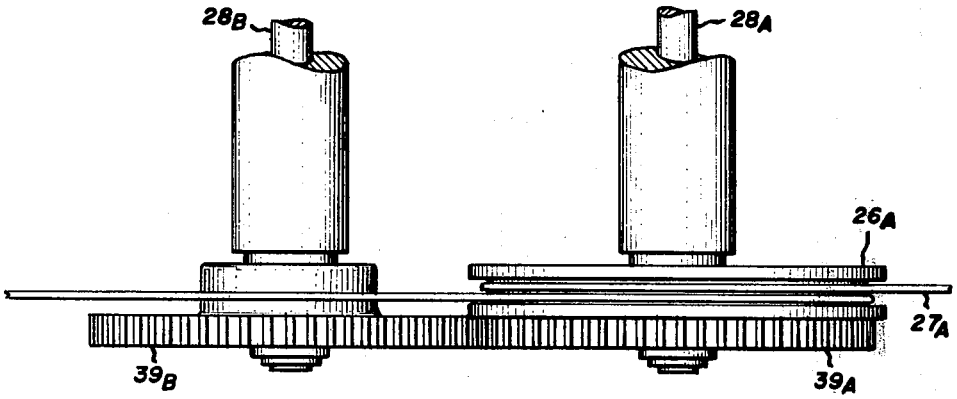

Although the present invention has been described with respect to several particular embodiments, the principles underlying the invention will undoubtedly suggest many additional modifications of these particular embodiments to those skilled in the art. For example, while a toothed belt 27 engaging a toothed double pulley arrangement 26 is employed to provide power take-off from carriage motion to control the ribbon drive, other drive take-off arrangements may be employed. For example, FIGS. 6 and 7 show that belt 27A could be a pulley cable which is wrapped one turn around one of two non-toothed pulleys 26A with power being coupled by gear 39A from shaft 28A to gear 39B coupled to shaft 28B. The pulley cable 27A extends from left to right except for the one turn wrap around pulley 26A. Therefore it is intended that the appended claims shall not be limited to the specific embodiment shown but rather shall cover all such modifications as fall within the true spirit and scope of the present invention.

What I claim as new and desire to secure by Letters Patent of the United States is:

1. A printer wherein a print head is mounted on a carriage and the print head and carriage are advanced in one direction to traverse a line of movement across a record medium to effect printing and are returned in an opposite direction to the beginning of said line of movement for effecting printing on a following line, an inked ribbon drive mechanism, means for causing said mechanism to move a ribbon in a stop and go and continuous movement across said record medium, said drive mechanism comprising a pulley, a driving means for moving said ribbon, a drive belt mounted to be stationary with respect to carriage and print head movement, said drive belt being wrapped around said pulley to drive the driving means in response to advance of said carriage and said print head.

2. A printer wherein a print head is mounted on a carriage and the print head and carriage are advanced in one direction from a starting position to traverse a line of movement across a record medium to effect printing with an inked ribbon and are returned in an opposite direction to said starting position for effecting printing on a following line comprising means for moving said inked ribbon relative to said print head, said means comprising a drive belt mounted to be stationary with respect to carriage and print head movement, means coupled to said drive belt for developing a driving force in response to advance of said carriage and said print head relative to said drive belt comprising a pulley carried by said carriage, means for engaging said pulley with said drive belt comprising said belt being wrapped around said pulley to impart rotary motion to said pulley as said carriage moves said pulley relative to said drive belt, and means for causing said inked ribbon to move relative to said print head in response to rotary motion of said pulley.

3. An arrangement according to claim 2 further comprising means coupled to said ribbon and responsive to said driving force to move said inked ribbon lengthwise relative to said print head during advance in said one direction and not in said opposite direction.

* * * * *